US009291343B2

(12) United States Patent
Suganuma et al.

(10) Patent No.: US 9,291,343 B2
(45) Date of Patent: Mar. 22, 2016

(54) BOILER STRUCTURE

(75) Inventors: Hiroshi Suganuma, Nagasaki (JP); Yuichi Kanemaki, Aichi (JP); Kazuhiro Domoto, Nagasaki (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 477 days.

(21) Appl. No.: 13/056,219

(22) PCT Filed: Jul. 2, 2009

(86) PCT No.: PCT/JP2009/062123

§ 371 (c)(1),
(2), (4) Date: Jan. 27, 2011

(87) PCT Pub. No.: WO2010/064466

PCT Pub. Date: Jun. 10, 2010

(65) Prior Publication Data

US 2011/0126781 A1 Jun. 2, 2011

(30) Foreign Application Priority Data

Dec. 3, 2008 (JP) ..... 2008-308470

(51) Int. Cl.
*F22B 21/00* (2006.01)
*F22B 21/02* (2006.01)

(52) U.S. Cl.
CPC ..... *F22B 21/02* (2013.01)

(58) Field of Classification Search
CPC ..... F22B 21/00; F22B 21/02; F22B 29/06; F22B 29/061; F22B 7/00; F22B 37/00
USPC ..... 122/235.12, 1 B, 406.1, 460, 406.4, 122/451 S, 459, 408.1, 235.11, 332, 235.23
See application file for complete search history.

(56) References Cited

U.S. PATENT DOCUMENTS 3,230,937 A 1/1966 Profos
3,399,656 A * 9/1968 Strohmeyer, Jr. ..... 122/406.4

(Continued)

FOREIGN PATENT DOCUMENTS

CN 87 1 01263 A 7/1988
GB 279178 A * 10/1927

(Continued)

OTHER PUBLICATIONS

Chinese Office Action dated Nov. 21, 2012, issued in corresponding Chinese Patent Application No. 200980131756.7, with English translation (15 pages).

(Continued)

*Primary Examiner* — Steven B McAllister
*Assistant Examiner* — Ko-Wei Lin
(74) *Attorney, Agent, or Firm* — Westerman, Hattori, Daniels & Adrian, LLP

(57) ABSTRACT

Provided is a boiler structure that allows for appropriate flow-rate distribution for each furnace wall by using a simple configuration without any moving parts in a wide thermal-load range of a furnace from a partial load to a rated load. In a boiler structure having a furnace water-wall formed of multiple boiler evaporation tubes and configured to generate steam by heating water inside the furnace when the water that is pressure-fed to the boiler evaporation tubes flows inside the tubes, the boiler structure includes a pressure-loss adjusting section, for an internal fluid, provided in an outlet connection tube that connects outlets of water walls obtained by dividing the furnace water-wall into multiple parts.

3 Claims, 11 Drawing Sheets

(56) References Cited

U.S. PATENT DOCUMENTS

| | | | | |
|---|---|---|---|---|
| 3,872,836 | A * | 3/1975 | Gorzegno et al. | 122/406.4 |
| 4,300,481 | A * | 11/1981 | Fisk | 122/406.3 |
| 5,713,311 | A * | 2/1998 | Fitzgerald | 122/406.5 |
| 6,445,880 | B1 * | 9/2002 | Hollander et al. | 392/485 |
| 6,817,319 | B1 * | 11/2004 | Manay | 122/235.23 |

FOREIGN PATENT DOCUMENTS

| | | | |
|---|---|---|---|
| GB | 490459 | A | 8/1938 |
| JP | 58-043308 | A | 3/1983 |
| JP | 59-084001 | A | 5/1984 |
| JP | 59-086802 | A | 5/1984 |
| JP | 59-129306 | A | 7/1984 |

OTHER PUBLICATIONS

International Search Report of PCT/JP2009/062123, mailing date Sep. 1, 2009.

Decision to Grant a Patent dated Jan. 8, 2013, issued in corresponding Japanese Patent Application No. 2008-308470 (3 pages).

Chinese Notification of Grant of Invention Patent dated Aug. 9, 2013, issued in corresponding Chinese Patent Application No. 200980131756.7, w/ concise explanation of relevance.

Extended European Search Report dated Jan. 22, 2016, issued in counterpart European Application No. 39830235.9 (6 pages).

* cited by examiner

BOILER STRUCTURE

TECHNICAL FIELD

The present invention relates to boiler structures that optimize the flow-rate distribution in boiler evaporation tubes (furnace water-walls).

BACKGROUND ART

In furnaces of supercritical variable-pressure once-through boilers in the related art, particularly, vertical-tube furnaces having furnace walls formed of multiple boiler evaporation tubes arrayed in the vertical direction, it is important to adjust the flow rate of an internal fluid flowing in the furnace walls.

Specifically, with regard to the flow-rate adjustment of the internal fluid flowing in the furnace walls (front wall, rear wall, and left and right walls), appropriate flow-rate distribution from a partial load to a rated load is necessary in accordance with the amount of heat absorbed by the respective wall surfaces. Therefore, in the boiler structure of the related art, orifices are provided at the furnace inlets for adjusting the flow rate of the internal fluid described above.

In a boiler device of the related art, a technology for performing distributive adjustment of the feedwater flow rate between the furnace walls or between divided blocks is known. In this technology of the related art, flow-rate control valves are provided at the inlets of the furnace walls, and the fluid temperature detected at the outlets of the furnace walls is input to a control device. Therefore, the control device automatically controls the feedwater flow rate and performs distributive adjustment by controlling the degree of opening of the flow-rate control valves so that the input fluid temperature at the outlets becomes equal to a target value (for example, see Patent Literatures 1 and 2).

CITATION LIST

Patent Literature

{PTL 1} Japanese Unexamined Patent Application, Publication No. Sho 59-86802

{PTL 2} Japanese Unexamined Patent Application, Publication No. Sho 59-84001

SUMMARY OF INVENTION

Technical Problem

In the aforementioned vertical-tube furnaces, since the internal fluid at the furnace inlets is in the form of water, a loss of pressure occurring due to the internal fluid passing through the orifices (also referred to as "pressure loss" hereinafter) is proportional to the square of the flow rate of the internal fluid.

Therefore, if the flow-rate distribution between the furnace walls is optimally adjusted by setting the orifice diameter of each furnace inlet in accordance with the rated load, the orifice effect (pressure loss) is reduced at the time of the partial load where the flow rate is low, resulting in an inability to achieve the optimal flow-rate distribution. On the other hand, if the flow-rate distribution between the furnace walls is optimally adjusted by setting the orifice diameter of each furnace inlet in accordance with the partial load, the orifice effect (pressure loss) becomes excessively high at the time of the rated load, resulting in an inability to achieve the optimal flow-rate distribution.

For example, in an example graph of flow-rate-percentage (ordinate) versus load (abscissa) shown in FIG. 3A, since the pressure loss is proportional to the square of the flow rate of the internal fluid, the front wall increases in flow-rate percentage with increasing load, whereas the rear wall decreases in flow-rate percentage with increasing load; therefore, the flow-rate distribution of the internal fluid relative to the front wall and the rear wall significantly fluctuates in accordance with the load condition.

Consequently, by adjusting the flow rate between the furnace walls using the orifices of the furnace inlets described above, optimal flow-rate distribution of the internal fluid over a wide flow-rate range from the partial load to the rated load is difficult. For this reason, the amount of internal fluid distributed to any one of the furnace walls becomes unbalanced relative to others, possibly causing the outlet steam temperature or the metallic temperature of the evaporation tubes to become significantly higher than that of other wall surfaces. In order to reduce the metallic temperature of the evaporation tubes to a permissible value or lower for all loads, it is necessary to take extreme care when adjusting the flow-rate distribution.

In the related-art technologies discussed in Patent Literatures 1 and 2, a control mechanism that adjusts the degree of opening of the flow-rate control valves in accordance with the fluid outlet temperature of the furnace walls is required.

The present invention has been made in view of the circumstances described above, and an object thereof is to provide a boiler structure that allows for appropriate flow-rate distribution relative to each furnace wall by using a simple configuration without any moving parts in a wide thermal-load range of a furnace from a partial load to a rated load.

Solution to Problem

In order to solve the aforementioned problems, the present invention employs the following solutions.

In a boiler structure according to an aspect of the present invention, having a furnace water-wall formed of multiple boiler evaporation tubes and configured to generate steam by heating water inside the furnace when the water that is pressure-fed to the boiler evaporation tubes flows inside the tubes, the boiler structure includes a pressure-loss adjusting section, for an internal fluid, provided in an outlet connection tube that connects outlets of water walls obtained by dividing the furnace water-wall into multiple parts.

With such a boiler structure, because the pressure-loss adjusting section for the internal fluid is provided in the outlet connection tube that connects the outlets of the water walls obtained by dividing the furnace water-wall into multiple parts, flow-rate adjustment is possible in an area in which the internal fluid flows mostly in the form of steam. Specifically, since the volume flow rate of the internal fluid mostly in the form of steam is substantially the same between a state under a rated load corresponding to a high-pressure high-mass flow rate and a state under a partial load corresponding to a low-pressure low-mass flow rate, the pressure loss in the outlet connection tube of the furnace is linearly proportional to the mass flow rate of the internal fluid, whereby flow-rate adjustment is facilitated for each of the multiple divided furnace walls.

In the aforementioned aspect, it is desirable that the pressure-loss adjusting section be configured by using one of or combining a plurality of individual adjustment of a pressure loss occurring in the outlet connection tube, a thick-walled short tube having the same outer diameter as the outlet connection tube and fitted therein, and a fixed orifice fitted in the outlet connection tube.

In this case, with the individual adjustment of the pressure loss occurring in the outlet connection tube, it is possible to adjust the pressure loss by varying at least one of the inner diameter of a tubular member used for forming the outlet connection tube, the number thereof, and the channel length thereof.

The thick-walled short tube having the same outer diameter as the outlet connection tube and fitted therein is formed of a tubular member whose inner diameter is reduced by increasing the wall thickness thereof, and can adjust the pressure loss by varying the inner diameter and the length thereof.

The fixed orifice fitted in the outlet connection tube can adjust the pressure loss by varying the orifice diameter thereof.

Advantageous Effects of Invention

With the present invention described above, since the flow-rate adjustment is performed in the outlet connection tube through which the internal fluid flows mostly in the form of steam, the pressure loss in the outlet connection tube of the furnace is linearly proportional to the mass flow rate of the internal fluid, whereby flow-rate adjustment is facilitated for each of the multiple divided furnace walls. Therefore, appropriate flow-rate distribution for each furnace wall is possible over a wide load range from a partial load to a rated load. As a result, a boiler structure that can maintain an appropriate steam temperature and an appropriate metallic temperature of the boiler evaporation tubes over a wide load range for each furnace wall is achieved. Specifically, it is possible to provide a boiler structure that allows for appropriate flow-rate distribution relative to each furnace wall by using a simple configuration without any moving parts in a wide thermal-load range of a furnace from a partial load to a rated load.

DESCRIPTION OF EMBODIMENTS

Embodiments of a boiler structure according to the present invention will be described below with reference to the drawings.

{First Embodiment}

Figure 1:
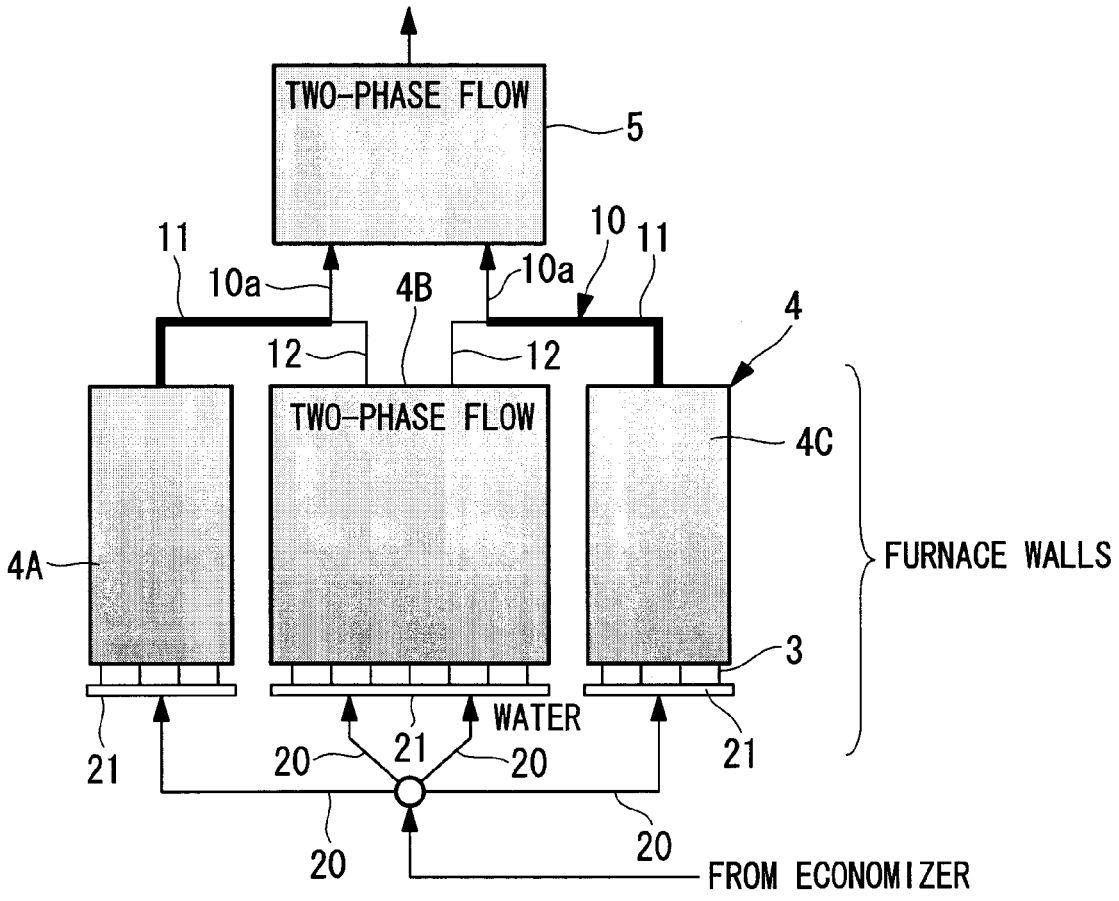
FIG. 1 is a system diagram illustrating a first embodiment, as an embodiment of a boiler structure according to the present invention.
Figure 2:
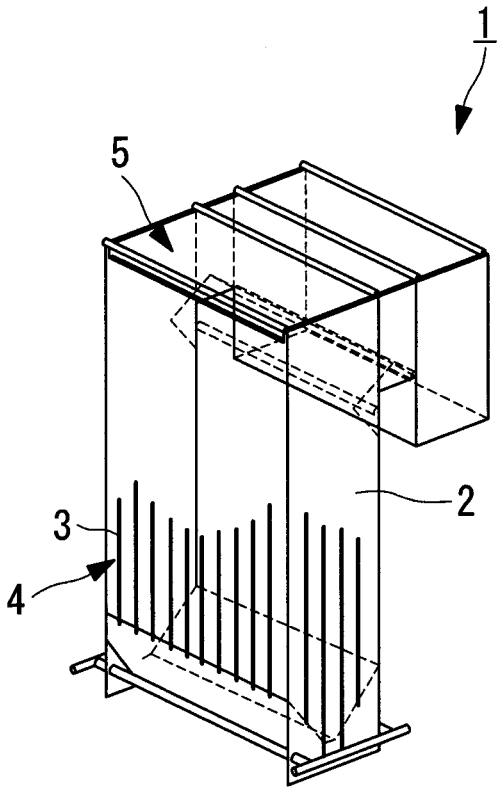
FIG. 2 is a perspective view schematically illustrating the boiler structure.

In an embodiment shown in FIGS. 1 and 2, a boiler 1 is a supercritical variable-pressure once-through boiler having furnace water-walls 4 formed of multiple boiler evaporation tubes 3 and configured to generate steam by heating water inside the furnace 2 when the water that is pressure-fed to the boiler evaporation tubes 3 flows inside the tubes. The boiler 1 in the drawings is rectangular in horizontal cross section of the furnace 2, and the furnace water-walls 4 are formed of four divided faces, i.e., front, rear, left, and right faces; for example, as shown in FIG. 1, the furnace water-walls 4 are connected to a roof water-wall 5 via outlet connection tubes 10.

In FIG. 1, the furnace water-walls 4 are divided into a left wall 4A, a front wall 4B, and a right wall 4C.

Water used for generating steam is fed to the aforementioned furnace water-walls 4 from an economizer The water fed from the economizer is distributed, via inlet connection tubes 20, to headers 21 respectively provided for the four divided furnace water-walls 4. The multiple boiler evaporation tubes 3 that extend in the vertical direction and form the furnace walls 4 are connected to the headers 21.

On the other hand, the outlet connection tubes 10 for the furnace water-walls 4 are each provided with a pressure-loss adjusting section for an internal fluid. The pressure-loss adjusting sections shown in FIG. 1 are configured to individually adjust the pressure loss occurring in the outlet connection tubes 10. Specifically, the pressure loss in the furnace water-walls 4 is individually adjusted by varying at least one of the inner diameter, the number, and the channel length of tubular members constituting the outlet connection tubes 10.

Regarding the inner diameter of the outlet connection tubes 10, tubular members having, for example, the same outer diameter but different wall thicknesses may be used, or tubular members having different outer diameters and different wall thicknesses may be used; tubular members with larger inner diameters (channel cross-sectional areas) provide smaller pressure losses.

Similar to the inner diameter described above, the number of outlet connection tubes 10 is set so as to perform pressure-loss adjustment by varying the channel cross-sectional area. In detail, by forming each outlet connection tube 10 using two tubular members, the channel cross-sectional area is doubled so that the pressure loss is reduced.

Regarding the channel length of each outlet connection tube 10, adjustment is performed by utilizing the fact that the pressure loss is proportional to the channel length. The channel length in this case is an equivalent tube length, and the pressure loss increases with increasing equivalent tube length.

Therefore, when the pressure loss in the outlet connection tubes 10 is to be adjusted for the respective divided furnace water-walls 4, at least one of the inner diameter, the number, and the channel length described above may be varied, or a plurality thereof may be combined. Specifically, in the configuration example shown in FIG. 1, although the pressure loss at the side walls and the front and rear walls is adjusted by varying the inner diameter and the channel length of tubular members 11 (indicated by thick lines) connected to the left wall 4A and the right wall 4C and tubular members 12 (indicated by narrow lines) connected to the front wall 4B, it is not limited to this. With regard to outlet connection tubes 10*a* extending from merging points of the tubular members 11 and 12, the inner diameter and the number thereof may be set to appropriate values in view of the total flow rate of the internal fluid.

The internal fluid flowing through the aforementioned outlet connection tubes 10 becomes a two-phase flow as a result of the water fed from the economizer being heated, and most of the internal fluid is in the form of steam. Therefore, the volume flow rate of the steam is substantially the same between a state under a rated load corresponding to a high-pressure high-mass flow rate and a state under a partial load corresponding to a low-pressure low-mass flow rate. Thus, the pressure loss in each outlet connection tube 10 of the furnace 2 is linearly proportional to the mass flow rate of the internal fluid, whereby appropriate flow-rate distribution relative to each furnace water-wall 4 can be readily achieved in a wide load range from the partial load to the rated load.

As a result, in each furnace water-wall 4, an appropriate steam temperature and an appropriate metallic temperature of the boiler evaporation tubes 3 can be maintained over a wide load range.

Figure 3A:
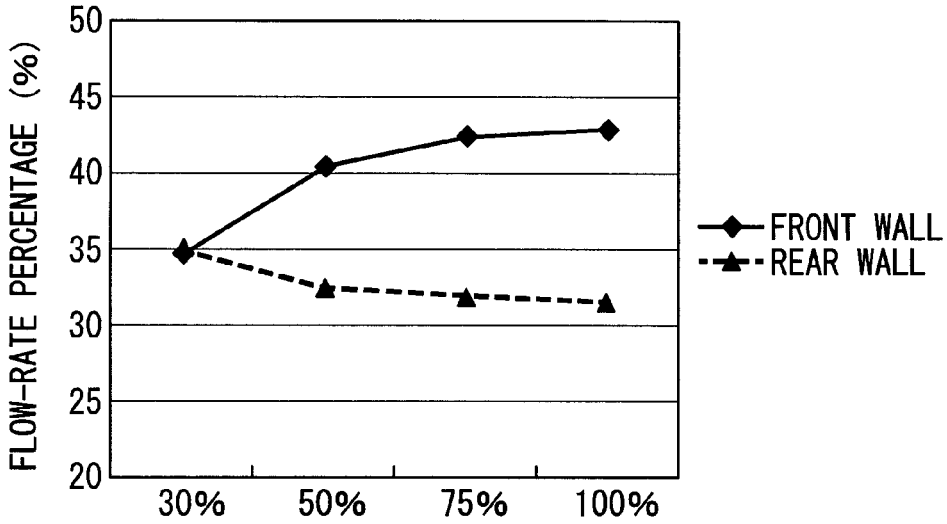
FIG. 3A is a diagram illustrating a flow-rate percentage (ordinate) of an internal fluid in a furnace water-wall that changes in accordance with the load (abscissa) of a boiler in a boiler structure of the related art.
Figure 3B:
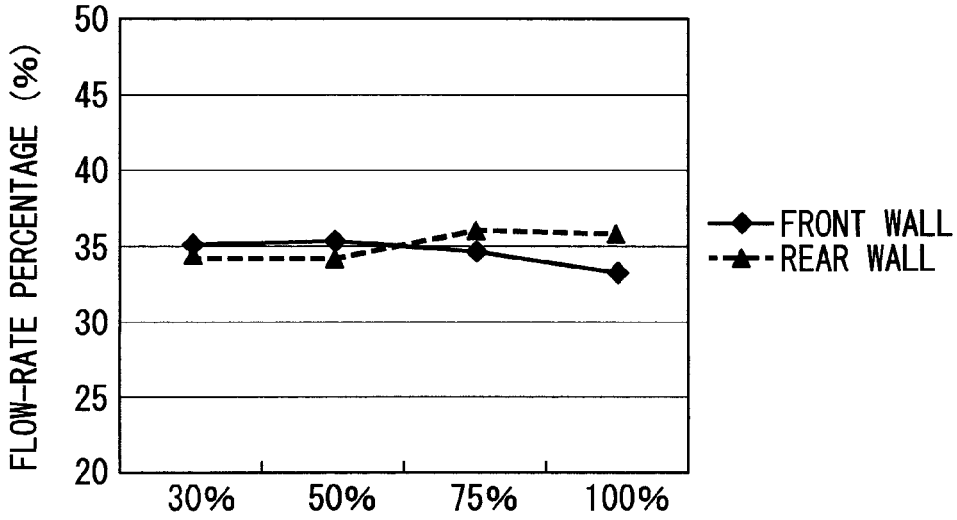
FIG. 3B is a diagram illustrating a flow-rate percentage (ordinate) of an internal fluid in a furnace water-wall that changes in accordance with the load (abscissa) of a boiler in a boiler structure of the present invention.

Specifically, in the present invention described above, since the internal fluid flows in the form of a two-phase flow with a large percentage of steam or in the form of steam, and the pressure-loss adjusting sections are each provided in an area (channel) in which the pressure loss is linearly proportional to the mass flow rate of the internal fluid, the pressure loss can be readily and reliably adjusted, whereby appropriate flow-rate distribution for each furnace water-wall 4 can be implemented over a wide load range of the boiler 1, as shown in FIG. 3B, without any moving parts, such as a control mechanism or a flow-rate control valve. In other words, by providing the pressure-loss adjusting sections of the present invention, the flow-rate distribution for each furnace water-wall 4 becomes stable with hardly any fluctuations in a wide load range of the boiler 1.

Figure 4:
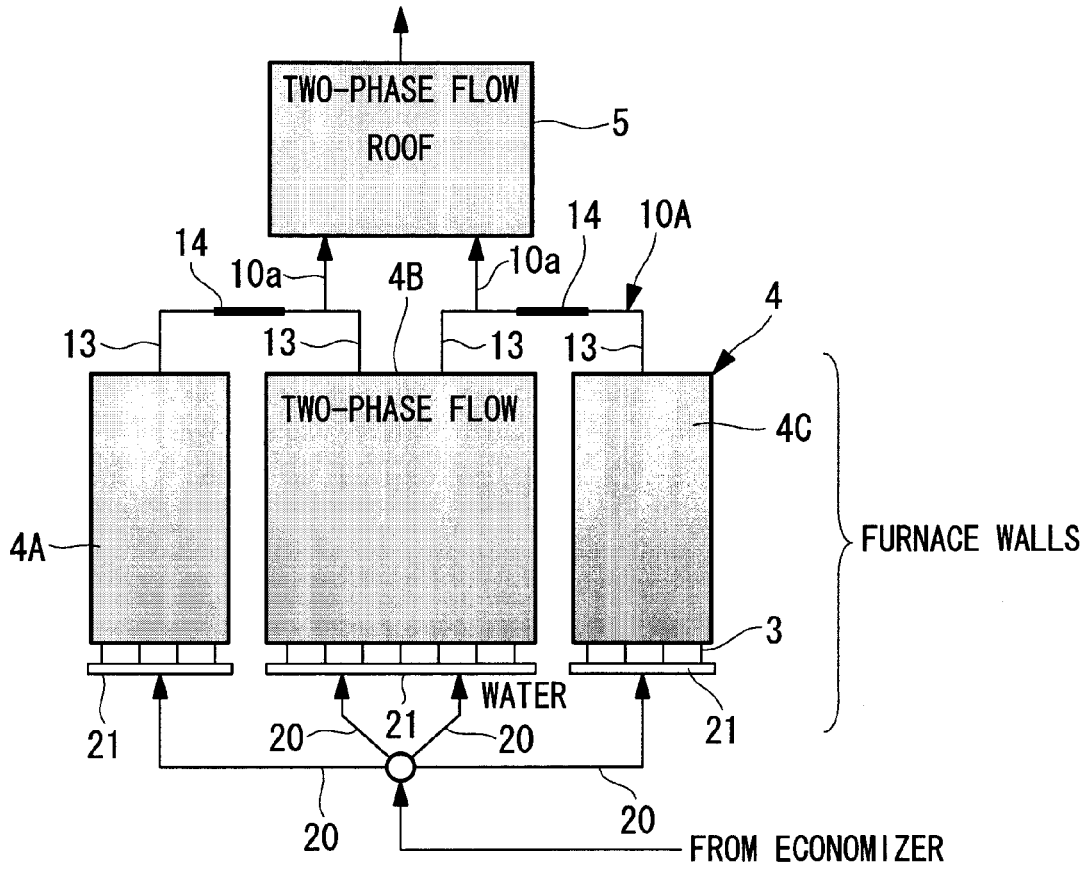
FIG. 4 is a system diagram illustrating a first modification of FIG. 1.

Next, a first modification of the above-described embodiment will be described with reference to FIG. 4. Components similar to those in the above-described embodiment are given the same reference numerals, and detailed descriptions thereof will be omitted.

In this modification, outlet connection tubes 10A are each formed by fitting a thick-walled short tube 14, having the same outer diameter as a tubular member 13, into the tubular member 13, and flow-rate distribution relative to each furnace water-wall 4 is optimally adjusted in accordance with the pressure loss occurring due to the internal fluid passing through the thick-walled short tube 14. In this case, regarding each thick-walled short tube 14, a tubular member having the same outer diameter as the corresponding tubular member 13 but given a reduced inner diameter by increasing the wall thickness thereof is used. Specifically, pressure-loss adjustment can be achieved by varying the inner diameter and the length of the thick-walled short tubes 14.

In such outlet connection tubes 10A, since the internal fluid flows in the form of a two-phase flow with a large percentage of steam or in the form of steam, and the thick-walled short tubes 14 of the pressure-loss adjusting sections are each provided in an area (channel) in which the pressure loss is linearly proportional to the mass flow rate of the internal fluid, the pressure loss can be readily and reliably adjusted, whereby appropriate flow-rate distribution for each furnace water-wall 4 can be implemented over a wide load range of the boiler 1 without using a control mechanism or a flow-rate control valve.

Figure 5:
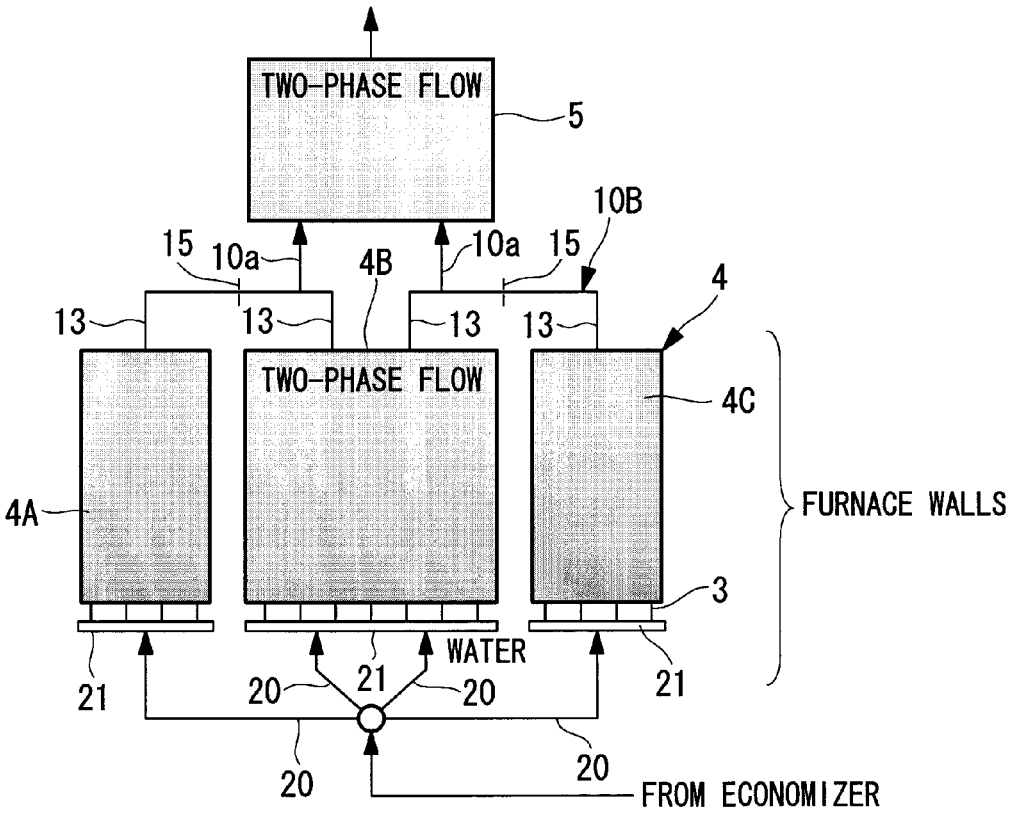
FIG. 5 is a system diagram illustrating a second modification of FIG. 1.

Next, a second modification of the above-described embodiment will be described with reference to FIG. 5. Components similar to those in the above-described embodiment are given the same reference numerals, and detailed descriptions thereof will be omitted.

In this modification, outlet connection tubes 10B are each formed by fitting an orifice 15 in a tubular member 13, and flow-rate distribution relative to each furnace water-wall 4 is optimally adjusted in accordance with the pressure loss occurring due to the internal fluid passing through the orifice 15. Each orifice 15 used in this case is a fixed orifice with a predetermined fixed orifice diameter. Specifically, pressure-loss adjustment can be achieved by varying the orifice diameter of the orifices 15.

In such outlet connection tubes 10B, since the internal fluid flows in the form of a two-phase flow with a large percentage of steam or in the form of steam, and the orifices 15 of the pressure-loss adjusting sections are each provided in an area (channel) in which the pressure loss is linearly proportional to the mass flow rate of the internal fluid, the pressure loss can be readily and reliably adjusted, whereby appropriate flow-rate distribution for each furnace water-wall 4 can be implemented over a wide load range of the boiler 1 without using a control mechanism or a flow-rate control valve.

With regard to the individual adjustment of the pressure loss occurring in the outlet connection tubes 10, the thick-walled short tubes 14 having the same outer diameter as the outlet connection tubes 10A and fitted therein, and the fixed orifices 15 fitted in the outlet connection tubes 10B, the aforementioned pressure-loss adjusting sections may be configured by using one of the above or combining a plurality of the above. Employing an optimal combination in accordance with the conditions can allow for, for example, finer adjustment of the pressure loss and an increased adjustment range.

{Second Embodiment}

In embodiments shown in FIGS. 6 to 11, furnace water-walls 6A, 6B, and 6C obtained by dividing a rear wall 6 into three parts are further provided in addition to the four divided walls, i.e., the left wall 4A, the front wall 4B, and the right wall 4C.

Water fed from the economizer to the rear wall 6 is heated, as in the furnace water-walls 4, so as to become a two-phase flow or vaporized internal fluid. This internal fluid is distributed to a channel line in which the internal fluid travels through an outlet connection tube 30, which connects the rear wall 6 and the downstream side of a roof water-wall 5, via an intermediate sub sidewall tube 7 so as to merge with steam generated by the furnace water-walls 4, and to a channel line in which the internal fluid travels through an outlet connection tube 31, which connects the rear wall 6 and the downstream side of the roof water-wall 5, via an intermediate rear-wall suspended tube 8 so as to merge with the steam generated by the furnace water-walls 4.

In such a boiler structure, each of the outlet connection tubes 30 and 31 is similarly provided with a pressure-loss adjusting section so that pressure-loss adjustment is performed.

Figure 6:
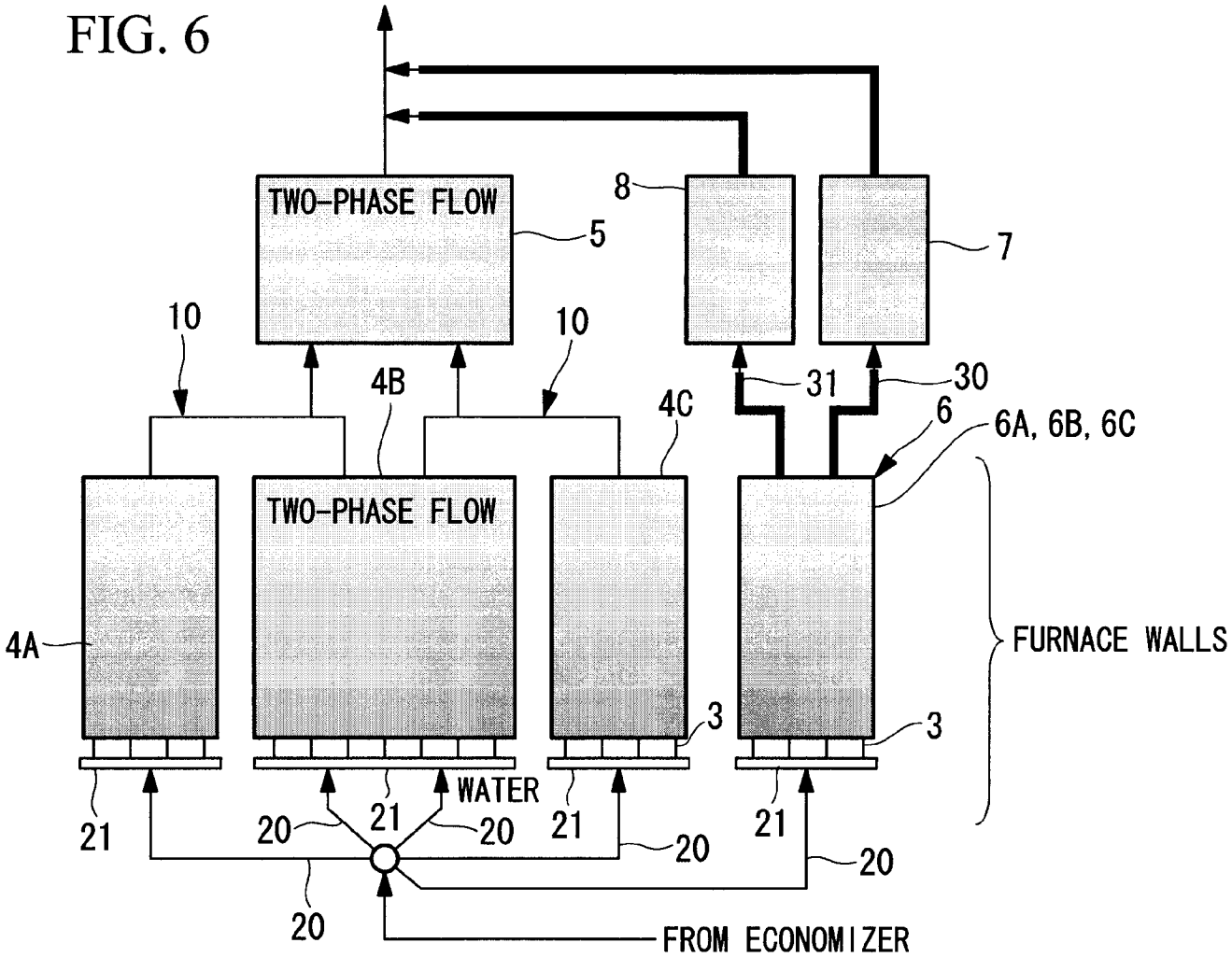
FIG. 6 is a system diagram illustrating a second embodiment, as an embodiment of a boiler structure according to the present invention.

In an embodiment shown in FIG. 6, the pressure-loss adjusting sections of the outlet connection tubes 30 and 31 individually adjust the pressure loss occurring in the outlet connection tubes 30 and 31 in which the internal fluid is mostly steam. Specifically, the pressure-loss adjustment is achieved by varying at least one of the inner diameter of tubular members used for forming the outlet connection tubes 30 and 31, the number thereof, and the channel length thereof.

Figure 7:
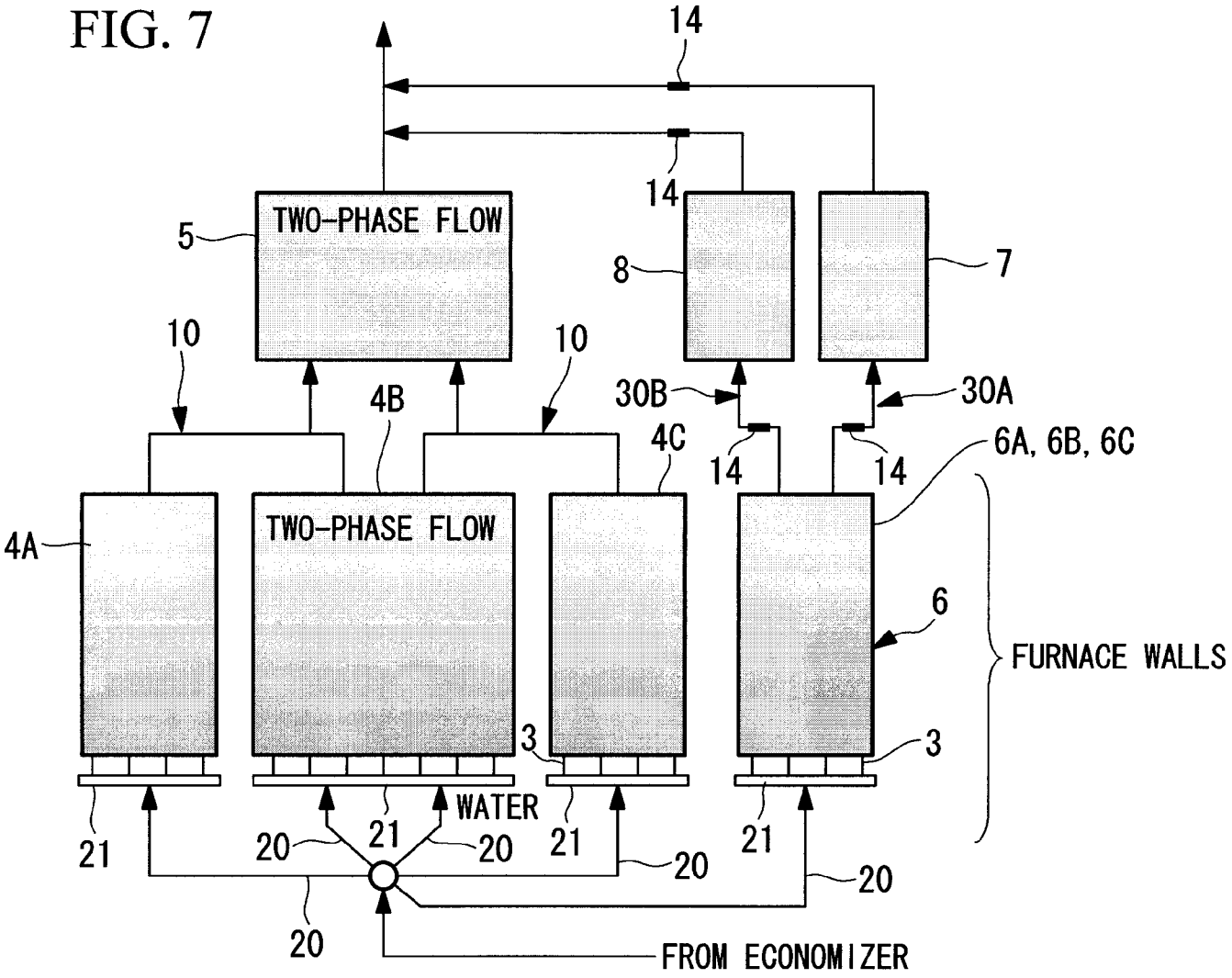
FIG. 7 is a system diagram illustrating a first modification of FIG. 2.

In a first modification of the present embodiment shown in FIG. 7, thick-walled short tubes 14 fitted in midsections of outlet connection tubes 30A and 31A, in which the internal fluid is mostly steam, are employed as pressure-loss adjusting sections of the outlet connection tubes 30A and 31A. Specifically, the thick-walled short tubes 14 whose inner diameter is reduced by increasing the wall thickness thereof and whose outer diameter is the same as that of the outlet connection tubes 30A and 31A are fitted in midsections of tubular members used for forming the outlet connection tubes 30A and 31A, and pressure-loss adjustment is achieved by varying the inner diameter and the length thereof.

Figure 8:
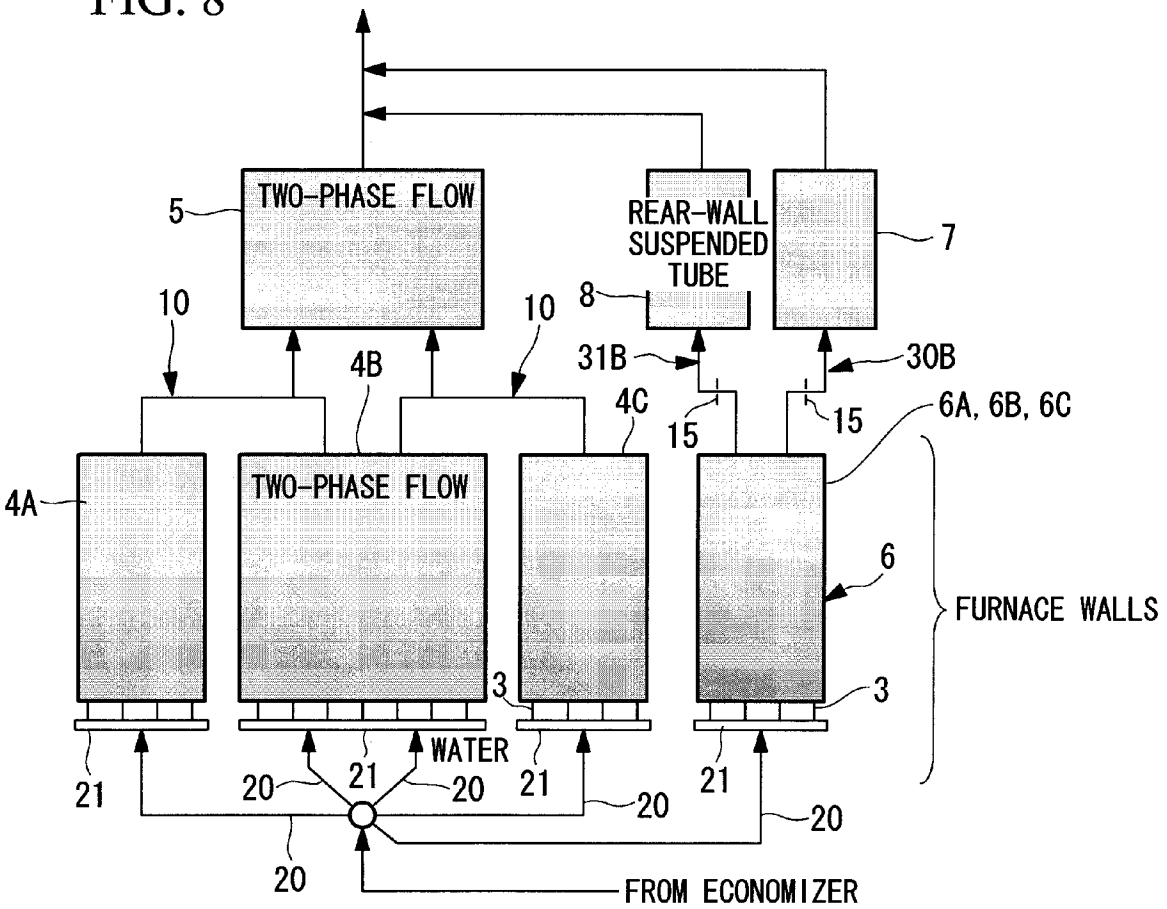
FIG. 8 is a system diagram illustrating a second modification of FIG. 2.

In a second modification of the present embodiment shown in FIG. 8, orifices 15 fitted in midsections of outlet connection tubes 30B and 31B, in which the internal fluid is mostly steam, are employed as pressure-loss adjusting sections of the outlet connection tubes 30B and 31B. Specifically, the orifices 15 are fitted in midsections of tubular members used for forming the outlet connection tubes 30B and 31B, and pressure-loss adjustment is achieved by varying the orifice diameter thereof.

The pressure-loss adjusting sections shown in FIGS. 6 to 8 may be configured by using any one of: the individual adjustment of the pressure loss in the outlet connection tubes 30 and 31 and the like, the thick-walled short tubes 14 fitted therein, and the orifices 15 fitted therein, or by combining a plurality of the above.

In these outlet connection tubes 30, 30A, 30B, 31, 31A, and 31B, since the internal fluid flows in the form of a two-phase flow with a large percentage of steam or in the form of steam, and the pressure-loss adjusting sections are each provided in an area (channel) in which the pressure loss is linearly proportional to the mass flow rate of the internal fluid, the pressure loss can be readily and reliably adjusted, whereby appropriate flow-rate distribution for each additional water-wall 6 can be implemented over a wide load range of the boiler 1 without using a control mechanism or a flow-rate control valve.

Figure 9:
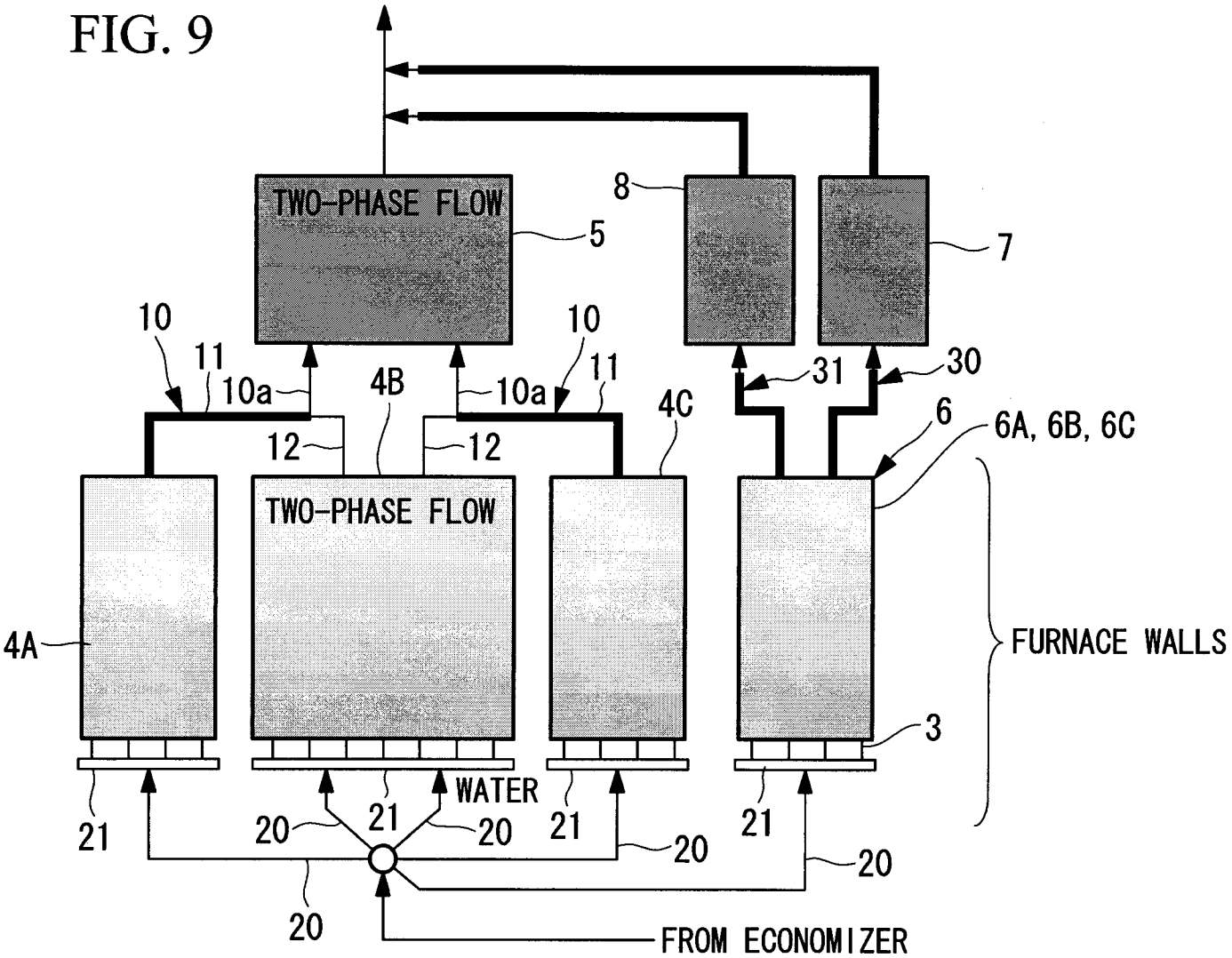
FIG. 9 is a system diagram illustrating a third modification of FIG. 2.
Figure 10:
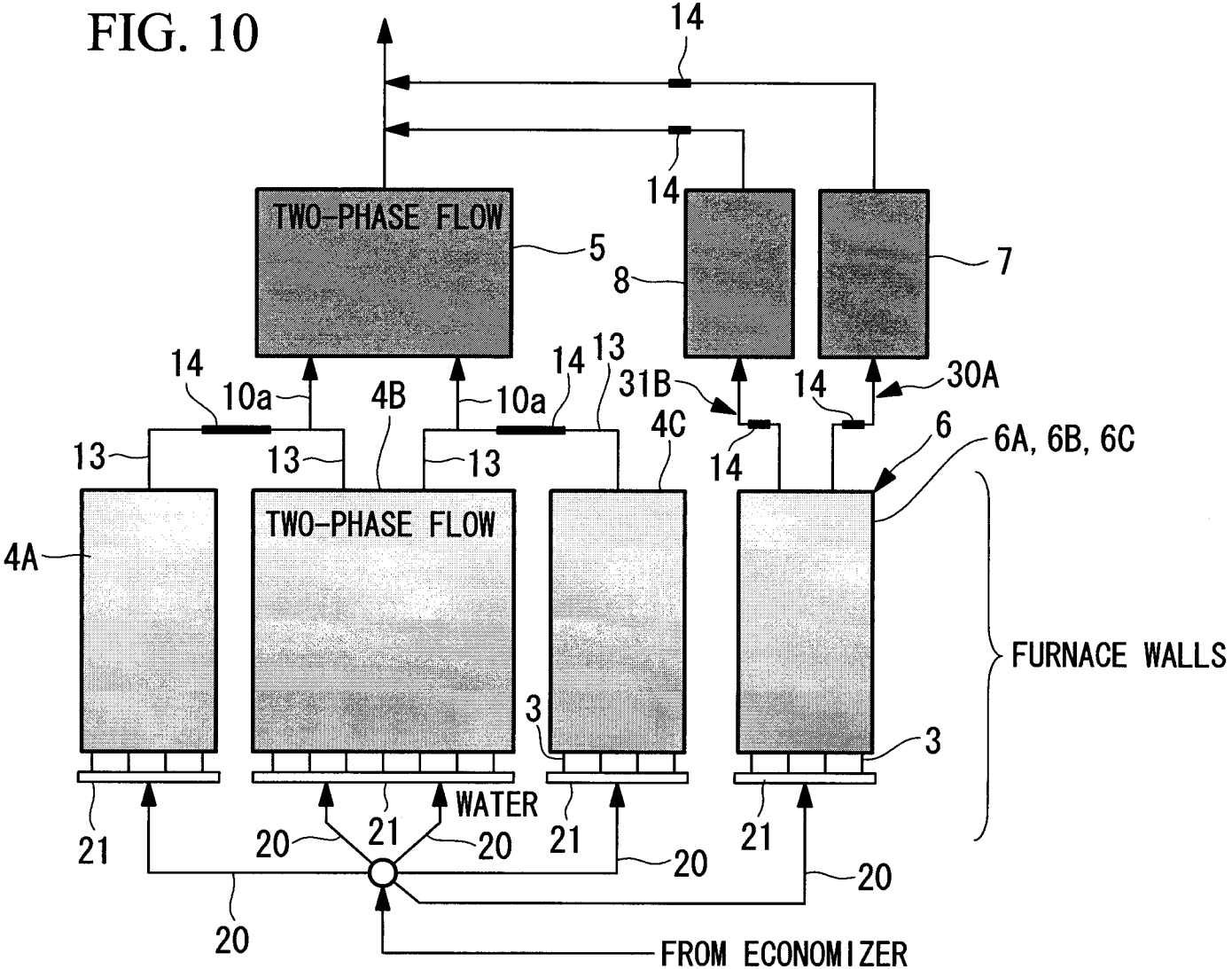
FIG. 10 is a system diagram illustrating a fourth modification of FIG. 2.
Figure 11:
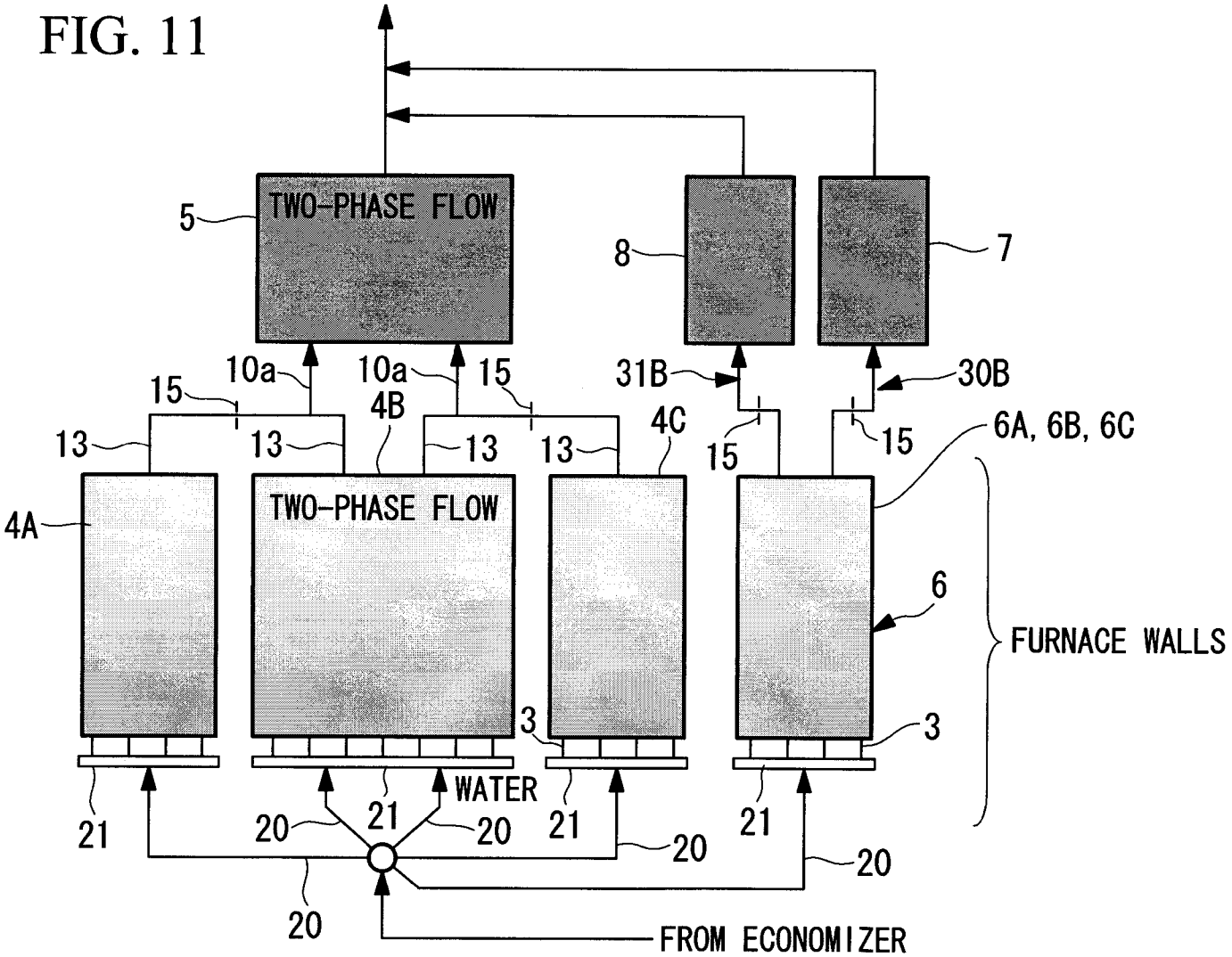
FIG. 11 is a system diagram illustrating a fifth modification of FIG. 2.

Modifications shown in FIGS. 9 to 11 each show a configuration example obtained by combining the second embodiment with the first embodiment described above. Specifically, a third modification shown in FIG. 9 is a combination of FIGS. 1 and 6, a fourth modification shown in FIG. 10 is a combination of FIGS. 4 and 7, and a fifth modification shown in FIG. 11 is a combination of FIGS. 5 and 8.

The combination of the first embodiment and the second embodiment is not limited to the combinations shown in FIGS. 9 to 11 and can be changed where appropriate, such as a combination of FIGS. 1 and 7.

With the boiler structure described above, since flow-rate adjustment is performed in the outlet connection tubes through which the internal fluid flows mostly in the form of steam, the pressure loss is linearly proportional to the weight of the internal fluid in the outlet connection tubes of the furnace water-walls, whereby the flow-rate adjustment is facilitated for each of the multiple divided furnace walls. Therefore, the boiler structure allows for appropriate flow-rate distribution to each furnace wall over a wide load range from a partial load to a rated load. As a result, in each furnace wall, an appropriate steam temperature and an appropriate metallic temperature of the boiler evaporation tubes can be maintained over a wide load range.

The present invention is not limited to the above-described embodiments, and modifications are permissible, where appropriate, so long as they are within the scope of the invention.

REFERENCE SIGNS LIST

1 boiler
2 furnace
3 boiler evaporation tube
4 furnace water-wall
5 roof water-wall
6 rear wall (furnace water-wall)
10, 10A, 10B outlet connection tube
14 thick-walled short tube
15 orifice
20 inlet connection tube
21 header

The invention claimed is:

1. A boiler structure, comprising:

a furnace formed of multiple water walls, each having a plurality of boiler evaporation tubes disposed on a wall surface of the furnace and configured to generate steam by heating water in the boiler evaporation tubes;

an inlet connection tube connected to an inlet of each of the water walls and the boiler evaporation tubes of each of the water walls receiving the water from the respective inlet connection tube to generate steam;

an outlet connection tube connected to an outlet of each of the water walls and the steam generated by heating water in the boiler evaporation tubes flows through the outlet connection tube of each of the water walls;

and one or more of pressure-loss adjusting sections being provided in the outlet connection tube of at least one of but less than all of the water walls so that pressure loss of the internal fluid flowing inside the outlet connection tube of the water walls provided with the one or more of the pressure-loss adjusting sections becomes different from pressure loss of the internal fluid flowing inside the outlet connection tube of the water walls without the one or more of the pressure-loss adjusting sections, wherein another end of the outlet connection tube of the water walls provided with the one or more of the pressure-loss adjusting sections communicating with another end of the outlet connection tube of the water walls without the pressure-loss adjusting sections.

2. The boiler structure according to claim 1, wherein each of the one or more of pressure-loss adjusting sections is configured to individually adjust the pressure loss of the internal fluid flowing inside the outlet connection tube, and the pressure-loss adjusting section comprises a thick-walled short tube which is provided as a part of the outlet connection tube and has a single cylindrical inner surface extending along the axis of the outlet connection tube and having a constant inner diameter, wherein the single cylindrical inner surface has a smaller inner diameter than an inner diameter of the rest of the outlet connection tube in which the pressure-loss adjusting section is provided.

3. The boiler structure according to claim 1, wherein each of the one or more of pressure-loss adjusting sections is configured to individually adjust the pressure loss of the internal fluid flowing inside the outlet connection tube so as to achieve an optimal flow-rate distribution, and the pressure-loss adjusting section comprises a fixed orifice fitted in the outlet connection tube.

* * * * *